US005105569A

United States Patent [19]

Straitiff

[11] Patent Number: 5,105,569

[45] Date of Patent: Apr. 21, 1992

[54] SINGLE SHOT PISTOL

[75] Inventor: Alfred R. Straitiff, Mason, N.H.

[73] Assignee: Richard A. Straitiff, Mason, N.H.

[21] Appl. No.: 504,374

[22] Filed: Apr. 3, 1990

[51] Int. Cl.[5] ..... F41A 19/13; F41A 19/34

[52] U.S. Cl. ..... 42/2; 42/69.01

[58] Field of Search ..... 42/2, 26, 32, 69.01, 42/1.16, 1.15, 1.14, 1.13, 1.12, 1.11, 1.09, 1.08

[56] References Cited

U.S. PATENT DOCUMENTS

| | | | |
|---|---|---|---|
| 2,195,711 | 4/1940 | Hutchison | 42/1.16 |
| 2,480,328 | 8/1949 | Johnston | 42/69.01 |
| 3,034,435 | 5/1962 | Schermuly | 42/69.01 |
| 3,561,149 | 2/1971 | Center | 42/41 |
| 3,707,794 | 1/1973 | Rocha et al. | 42/69.01 |
| 4,689,912 | 9/1987 | Gillum | 42/69.01 |

*Primary Examiner*—Michael J. Carone

*Attorney, Agent, or Firm*—Hamilton, Brook, Smith & Reynolds

[57] ABSTRACT

Disclosed is a single shot pistol having a barrel 2, a grip 4, a trigger 6 and a firing pin 44, with a receiver 22 secured to the barrel. A cap 28 is threaded onto the receiver for relative rotation. Striker mechanism 52 extends from the trigger to the firing pin and is actuated by camming mechanism 70 in the cap upon the cap being rotated relative to the receiver.

13 Claims, 5 Drawing Sheets

SINGLE SHOT PISTOL

Field of the Invention

The invention relates to firearms in general and more specifically to a single shot, ambidextrous pistol which is very strong and durable and capable of firing large and small caliber ammunition by the use of interchangeable barrels.

Background of the Invention

Many hunters and silhouette shooters today like to employ firearms with interchangeable barrels that present the choice of several calibers of ammunition to accomplish different things. For example, shooting at different ranges or changing from hunting to silhouette shooting often requires a change in ammunition size and power. Hunting at long ranges requires a larger caliber than silhouette shooting at a shorter range.

There is at least one single shot pistol on the market today that accommodates interchangeable barrels with different calibers and, being in a reasonable price range, is popular. It employs a break-open design in which the barrel pivots but it does not have exceptional strength. This obviously creates problems with large caliber ammunition. On the other hand, bolt actions have great strength and are adapted to large caliber ammunition. However, bolt actions are only convenient for either a left-handed or right-handed shooter. Thus, there is an advantage in a handgun or pistol that can be cocked ambidextrously. If this can be combined with barrel interchangeability and an ejection system with strength that approaches that of a bolt-action rifle, a very desirable handgun can be produced. This is the primary objective of the present invention.

Summary of the Invention

The invention resides in an ambidextrous, single shot pistol having a barrel, a grip, a trigger and a firing pin. A receiver is secured to the rearward end of the barrel away from the muzzle. A substantially hollow cap is threaded onto the receiver for relative rotation. A striker mechanism extends from the trigger to the firing pin and a camming ramp is located in the cap for cocking the striker mechanism upon the cap being rotated relative to the receiver.

Ejector mechanism is located in the receiver for ejecting a cartridge. The same camming ramp in the cap that is employed for cocking the striker mechanism is employed for actuating the ejector mechanism upon the cap being rotated relative to the receiver.

There is a safety mechanism in the cap actuated manually and a second safety mechanism associated with the trigger.

The barrel may be interchanged with one or more additional barrels of different caliber. The ejector mechanism is also interchangeable with ejector mechanisms of different sizes to accommodate different size cartridges.

The above and other features of the invention, including various novel details of construction and combinations of parts will now be more particularly described with reference to the accompanying drawings and pointed out in the claims. It will be understood that the particular single shot pistol embodying the invention is shown by way of illustration only and not as a limitation of the invention. The principals and features of this invention may be employed in varied and numerous embodiments without departing from the scope of the invention.

Detailed Description of the Invention

Figure 1:
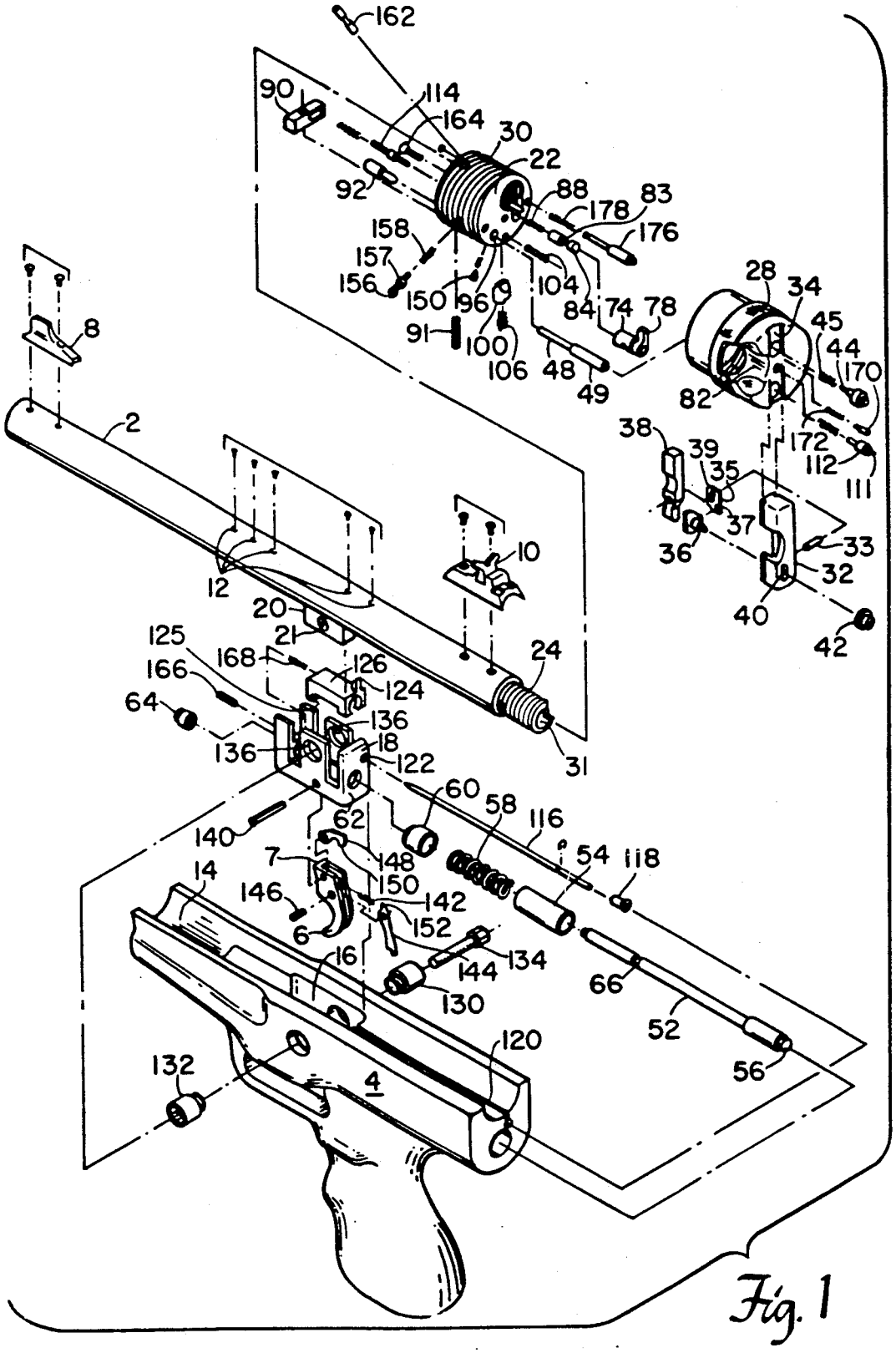
FIG. 1 is an exploded detailed view a single shot pistol embodying the invention.

The invention is embodied in a single shot pistol having a rotary breech. The postol is self-cocking and self-ejecting on opening. It includes an interchangeable barrel 2 which allows for the selection of barrels in calibers and types from twenty-two rim fire to belted magnum. The barrel is received in a grip 4 which may be constructed of wood, plastic or other appropriate material. The gun includes a trigger 6. A front sight 8 and a rear sight 10 (FIG. 1) are removably secured to the barrel by screws. Disclosed herein is a fixed-ramp front sight and a Williams rear sight, although they may be interchanged with other types of sights. The barrel is provided with a plurality of holes 12 for securing a scope, the holes normally being plugged by screws when a scope is not employed. The grip 4 is formed with a concave depression 14 shaped to received the barrel 2 and a substantially rectangular opening 16 to accommodate a grip insert 18 which, in turn, receives a substantially rectangular lug 20 formed on the bottom of the barrel. A bore 21 is formed through the lug 20.

Threaded onto the rearward end of the barrel 2 is a receiver 22. Threads 24 on the barrel engage mating threads 25 in the receiver. The receiver is a principal part of the firearm carrying the serial number and which requires federal bookkeeping when a pistol is sold. A cap 28 is threaded onto the receiver 22 by means of square threads 30 having a double start which permits greater relative movement.

Functionally, turning the cap 28 clockwise as viewed in FIGS. 1 and 3, first cocks a striker hereinafter to be described in greater detail, and then cams an ejector also to be described, to eject a cartridge from the pistol. With the cap open, a cartridge can be placed in the chamber 31 which is formed in the barrel 2. The cap 28 is then rotated approximately 100° in a counterclockwise direction as viewed in FIG. 1 and FIG. 3 to its closed position. The gun may then be fired after releasing a safety. The cap 28 functions to close the receiver or action and allows the pressures developed by firing the cartridge to be contained safely.

Figure 2:
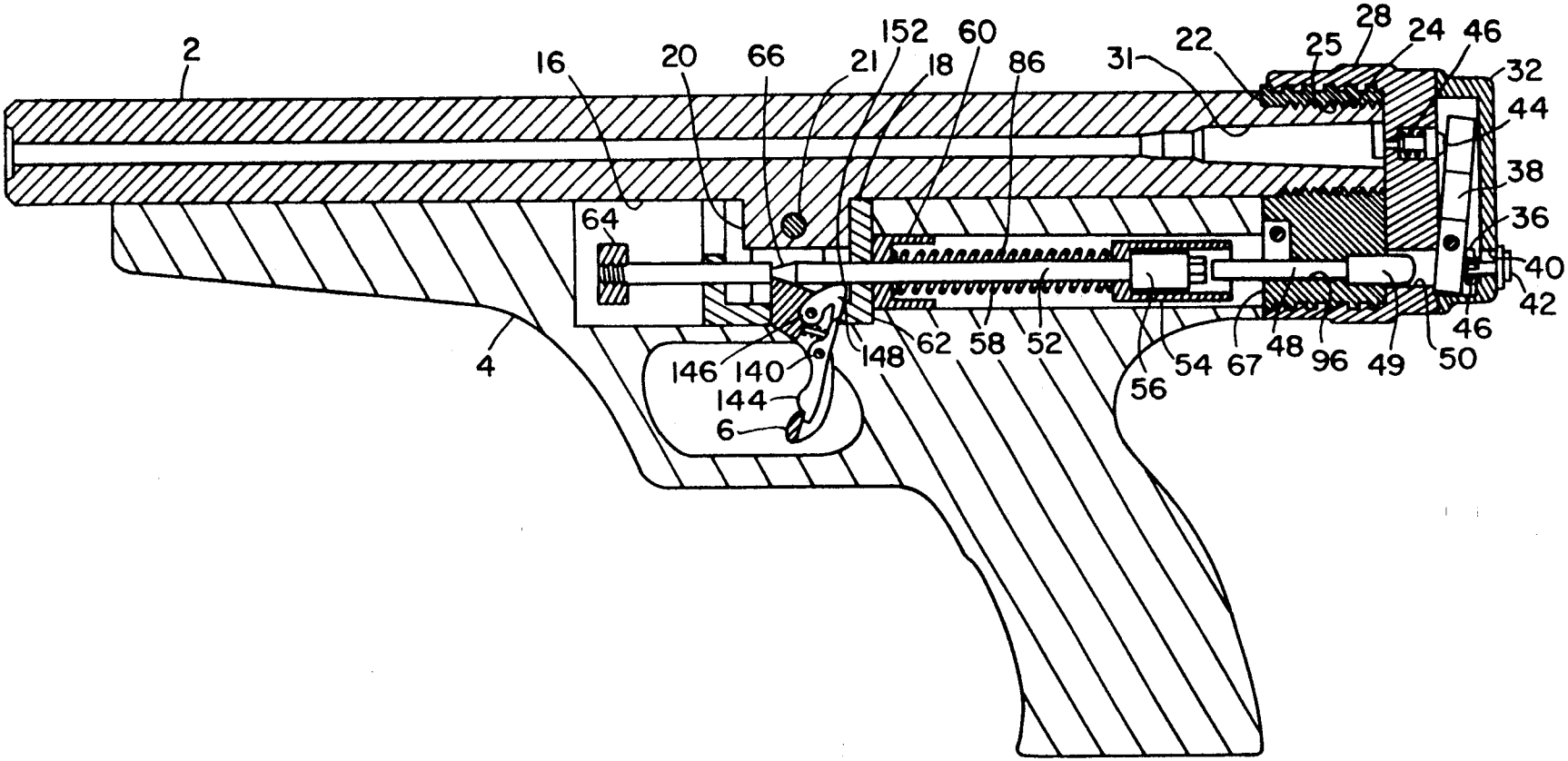
FIG. 2 is a sectional view of the pistol.

Referring to FIG. 2, a hollow cap insert 32 is received in a T slot 34 in the cap 28. The cap insert contains a rear safety 36 and an energy transfer bar 38. The safety rides in a slot 40 in the cap insert 32. The rearward or exposed end of the safety 36 mounts a finger engaging button 42 to permit it to be moved from an "on" position when the safety is at the bottom of the slot 40 to an "off" position when the safety is in the upper portion of the slot 40.

Also located in the cap 28 is a firing pin 44 which is spring biased rearwardly or to the right as viewed in FIG. 2, by a coil spring 46. The energy transfer bar 38 transfers energy from a striker rod 52 through a transfer pin 48 which slides in the receiver 22, to the firing pin 44 which, in turn, strikes the primer of a cartridge causing the pistol to be fired.

The transfer pin 48 has an enlarged head 49 which extends into a bore 50 (FIGS. 2, 3, 5 and 6), the function of which will be described in greater detail hereinafter. A striker rod 52 is located inside of a rebound cup 54 and is surrounded by a compression spring 58 which bears against the cup 54 and a bushing 60 which is pressed by the force of the spring 58 against the rear wall 62 of the grip insert 18. The striker rod 52 passes through the grip insert 18 and has mounted on its forward end a nut 64. A sear notch 66 is formed in the striker rod 52 and is engageable by the upper end 7 of the trigger 6.

FIG. 2 shows the pistol in cocked position with the upper end 7 of the trigger 6 engaged in the sear notch 66. When the trigger 6 is pulled and its upper end 7 disengaged from the notch 66 in the striker bar 52, the spring 58 forces the striker rod 52 rapidly rearwardly with the right hand end of the striker rod hitting the transfer pin 48 which in turns pivots the transfer bar 38 in a counter-clockwise direction as seen in FIG. 2 causing the firing pin 44 to engage the primer of a cartridge thus firing the pistol. After firing, the end of the rebound cup 54 will abut the forward wall 67 of the receiver. The head 49 of the pin 48 is then within the bore 50 of the cap 28.

Figure 5:
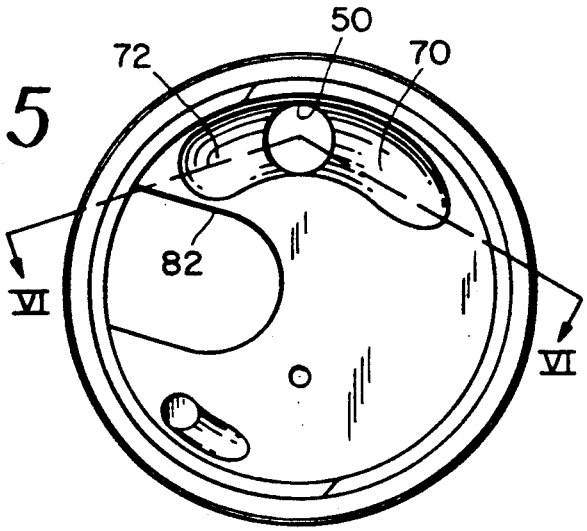
FIG. 5 is a view looking into the cap.
Figure 6:
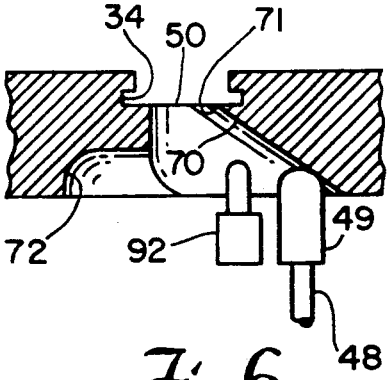
FIG. 6 is a sectional view taken along the line VI—VI on FIG. 5.

Referring next to FIGS. 5 and 6, leading from the bore 50 in the cap 28 is a curved camming surface 70 formed in the cap and which may also be called the primary or cocking cam. On the other side of the bore 50 is a arcuate recessed surface 72 which is the closed stop surface. Upon partial opening, the breech, by rotating the cap 28, the head 49 of the transfer pin 48 and the ejector plunger 92 (described in greater detail hereinafter) are essentially in the positions shown in FIG. 6.

Figure 3:
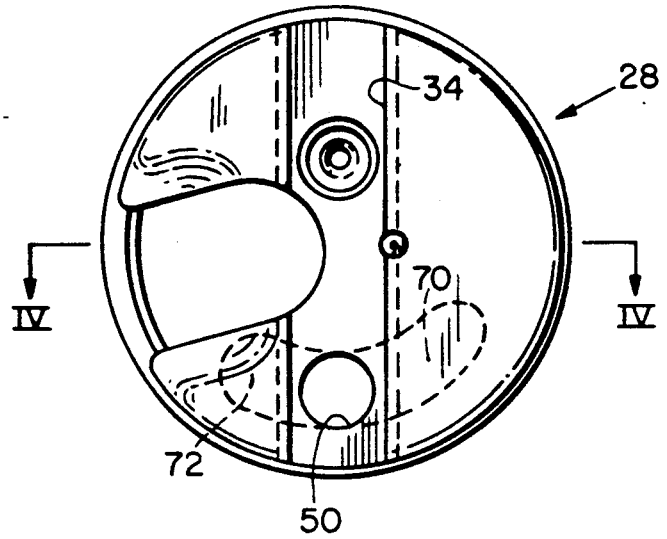
FIG. 3 is a rear view of the cap of the pistol.
Figure 4:
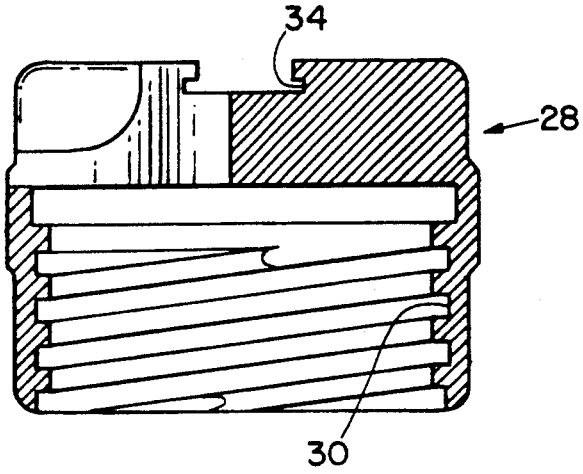
FIG. 4 is a sectional view taken along the line IV—IV of FIG. 3.

Manual rotation of the cap 28 in a clockwise direction as viewed in FIG. 3 and a counter-clockwise direction when looking into the cap as seen in FIG. 5, causes the head 49 of the transfer pin 48 to be cammed outwardly of the cap or to the left as viewed in FIG. 2, thus engaging and moving the striker rod 52 to the left against the force of the spring 58 until the sear notch 66 becomes engaged with the top 7 of the trigger thus cocking the pistol and moving the parts into the position shown in FIG. 2. Thereafter, in the closed position the head 49 of the transfer pin 48 is aligned with the bore 50 and the ejector plunger 92 is against the closed stop or recessed surface 72 preventing further rotation of the cap 28.

Figure 8:
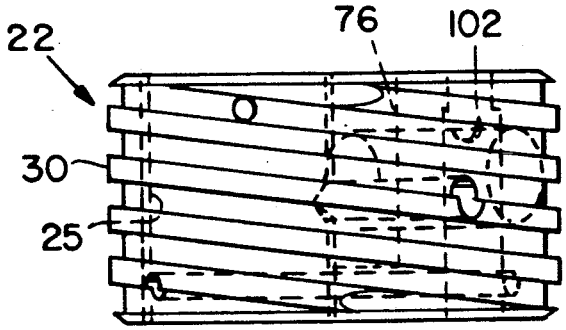
FIG. 8 is a top view of the receiver.

The ejector 74 (FIGS. 1, 10 and 11) is located in a bore 76 (FIG. 8) in the receiver 22. The ejector is an interchangeable part which is contoured to fit most standard calibers that would ever be used in firearms. The ejector is custom fitted for the caliber to be used, as is the barrel. The ejector 74 seen best in enlarged view in FIGS. 10 and 11 and includes an arm 78 having a nose 80 which actually engages and forces a cartridge or casing out of the receiver 22 through an aperture 82 in the cap 28.

A plunger 84 (FIG. 11) fits within a recess 86 in the ejector 74 and is urged by a compression spring 88 in a rearwardly direction which gives the ejector the energy to force the cartridge or casing out of the chamber.

Located in the forward face of the receiver 22 is a rocker 90. It is mounted for pivotal movement to transfer energy from plunger 92 which is the ejector cam pin, through to the bottom of the ejector 74 which starts movement of a cartridge from the chamber 30 and, therefore, initiates ejection.

Figure 7:
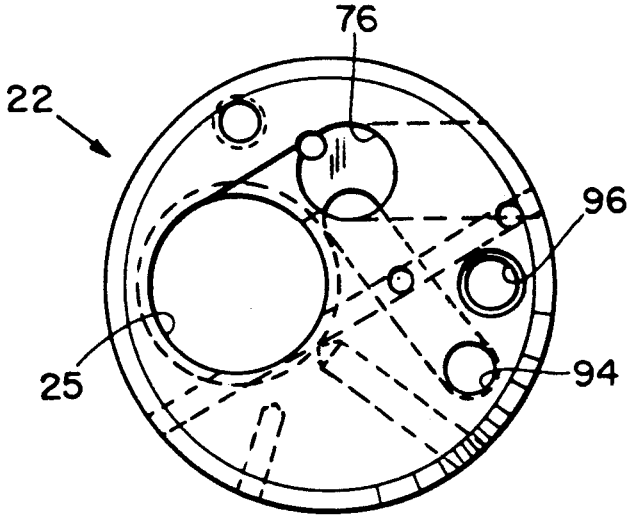
FIG. 7 is a rear view of the receiver.
Figure 9:
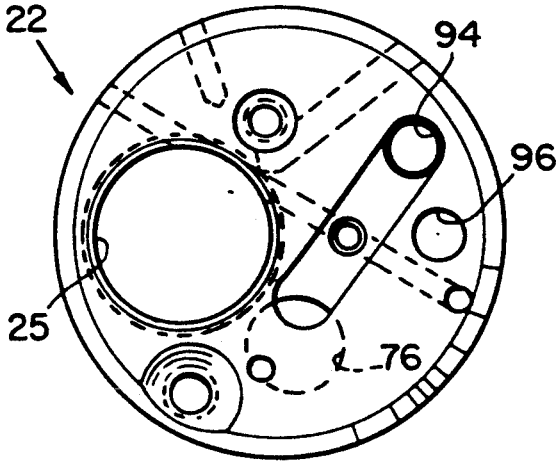
FIG. 9 is a view looking at the front of the receiver.

Ejector cam pin 92 slides in a bore 94 (FIGS. 7 and 9) in the receiver which is close to and parallel with the bore 96 in the receiver in which the transfer pin 48 slides. The ejector cam pin 92 gets its motion by way of the camming surface 70 from the rotation of the cap 28 simultaneously with the camming motion imparted to the transfer pin 48.

Figure 10:
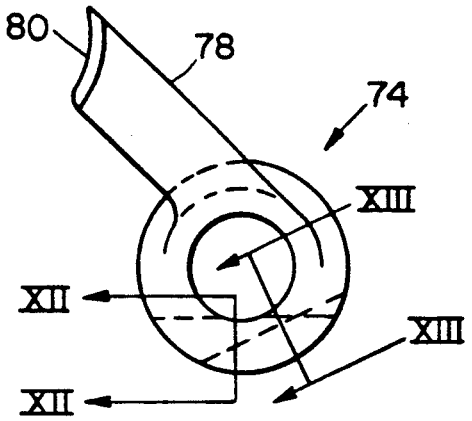
FIG. 10 is a front view of the ejector.
Figure 11:
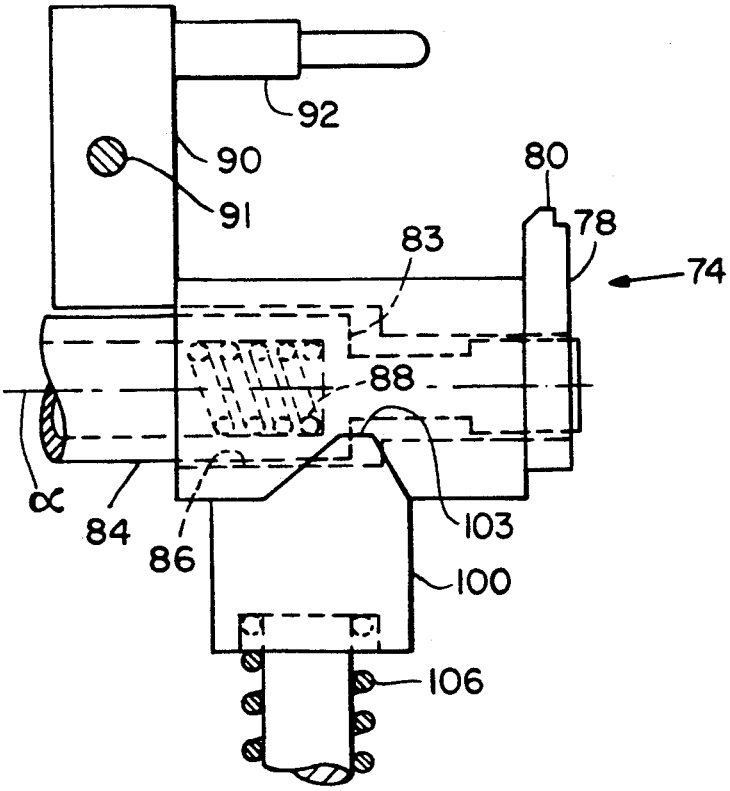
FIG. 11 is a top view thereof.
Figure 13:
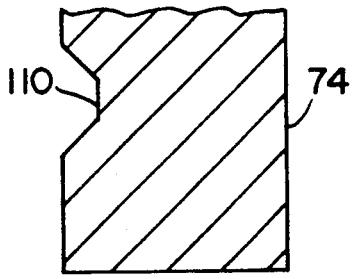
FIG. 13 is a section of the ejector taken along the line XIII—XIII.

An ejector lock 100 (FIG. 11) is located in the receiver 22. It is received in a bore 102 (FIG. 8) and is engageable with an ejector lock pin 104 which has a pair of grooves formed in it. The grooves of the pin correspond to the diameter of a spring 106 which holds the ejector lock 100 in place. The top of the spring bears on the ejector lock 100 forcing it inwardly in the receiver 22. The force of the spring 106 on the lock 100 creates constant pressure which holds the ejector 74 in the receiver at all times. It also causes the ejector to pivot as a result of engagement with dual angle cutouts 108 and 110 (FIG. 10).

Figure 12:
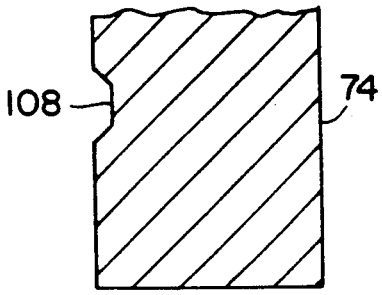
FIG. 12 is a section of the ejector taken along the line XII—XII.

As the cap is rotated, the forward end of pin 92 rides on cam 70 which forces it toward the muzzle of the gun causing it to move the rocker 90, which, in turn, pivots on pin 91, causing a rearward movement of the rear side of the ejector 74. This forces the ejector rearward so that cutout or notch 108 (FIG. 12) in the body of the ejector 74 contacts the nose 103 of ejector lock 100 forcing it towards the side of the receiver 22 which creates a disengagement of the nose 103 in the front of lock 100 that is being disengaged from part 84. Lock 100 then becomes disengaged from shoulder 83 on plunger 84 allowing spring 88 to force the ejector 74 rapidly rearward under spring pressure. At that time, the nose of cutout 110 comes in contact with the lower cam surface creating a circular rotation of the ejector about the axis $\alpha$ which gets the ejector 74 out of the way of the cartridge which is then being moved out by the spring pressure.

Referring again to FIG. 1, a slider 35 is located in the cap insert 32. It is positioned along the side of the transfer bar 38 and is keyed to the safety 36 by an ear 37. It is hence moved by moving the safety button 42, and hence the safety 36, it moves a pin 112 also known as the cap plunger safety pin. It, in turn, is spring biased rearwardly in the cap 28. Movement of the pin 112 causes it to bear on a pin 114 which is also slideably received in the receiver 22. A ramp 39 on the slider 35 engages a spherical pin 111 on pin 112, which is the cap safety plunger. This is a safety disconnect and which pushes through the cap 28 into the receiver 22 and onto the pin 114 located in the receiver 22. It transfers movement created from moving the safety button 42. From the receiver 22, pin 114 goes to the grip assembly and creates a forward movement of the grip pin 116, which is the grip safety pin. That movement is transferred to the grip assembly, the end of the pin 116 contacting an ear 124 on the trigger catch, which creates forward movement to release the trigger and allow the trigger safety 144 then to be depressed permitting the trigger to be pulled to fire the gun.

The safety lever pin 146 which is located in the trigger 6 not only retains the trigger safety lever 144 and, therefore, allows it to pivot and also to retain the spring 142 which gives it energy, but an ear 152 on the top of the lever retains the spring 142.

Located parallel to the striker rod 52 is a grip pin 116 which is slideably mounted in a bushing 118 and moves lengthwise a slot 120 in the grip 4. The forward end of the grip pin 116 passes through an aperture 122 in the grip insert 18 and bears against a tang 124 mounted on a trigger catch 126 in the grip insert 18 and which will be described in greater detail hereinafter.

The grip pin 116 is moved toward the muzzle of the gun and in turn unlocks the trigger catch 126. The movement of the trigger catch in turn unlocks the trigger 6 allowing it to be depressed and therefore fired.

The grip insert 18 is a machined steel part which contains all of the trigger components and is located in the recess 16 in the grip 4. It is held in place by three bushings, the bushing 60 through which the striker 52 rod passes and two lateral bushings 130 and 132. A threaded screw 134 passes through the latter bushings, as well as apertures 136 in the grip insert.

The trigger 6 pivots on a pin 140 which is fitted in the grip insert. A spring 142 fits in a bore in the trigger 6 and bears against the top of the trigger safety lever 144. In turn, the safety lever pivots on a pin 146 which passes through the trigger. Also pivoted on the trigger 6 is a trigger safety lock 148 having a nose 150 which latches behind the trigger safety lever 144. The trigger safety lock 148 is, in turn, secured in place through the pressure of the spring 142. Safety lock 148 rests on the pin 140 and bears on the underside of the striker rod 52 and which is contained in the grip and held in place by the nut 64.

The spring 58 surrounding the striker rod 52 moves the striker to pivot the transfer bar 38, and it also puts pressure on the rebound cup or bushing 54. Its second purpose is that after its energy is expended on the transfer pin 48, it creates a rebound assembly so that the pressure is then relieved from the transfer pin after firing. When it is in the fired position and the spring pressure is on, the bushing 54 rather than on the striker rod itself. For this reason, the element 54 is also called the rebound cup.

A transfer pin retaining plunger 150, comprising a small plunger with a spherical end, is spring biased outwardly from the receiver 22. The purpose of the transfer pin retaining plunger is to exert force on the transfer pin to keep it from rattling inside the receiver and falling out.

Element 156 is the cap positioning plunger. It is located in the side of the receiver 22 and it is held in place by the ejector cam pin 92, an undercut 157 in the plunger clears the ejector cam pin 92 as it is assembled. Plunger 156, in turn, holds the ejector cam pin 112 in place from energy created by the spring 158. Pin 156 engages notches that are inside the cap to create a hold open and hold closed position of the cap 28 which prevents it from moving individually by itself while carrying or handling the firearm. The cap positioning plunger 156 moves radially at a 90° angle to the axis of the receiver. Element 158 is the spring which gives energy to the plunger.

A barrel lock pin 162 is a round pin with a radius turned in the center and a flat on one side. The flat locates the barrel on a corresponding location not shown giving it orientation and location inside the receiver. The radius in the center of the pin is to match the radius of the pin on the barrel lock screw 164. The screw is threaded into the back of the receiver 22 retaining the lock pin 162 which in turn retains the barrel 2 in place. The trigger catch element 126, as explained above, is a device inside the trigger assembly which locks the trigger 6 to prevent accidental firing. This is accomplished by the upper projecting end 7 of the trigger 6 engaging beneath a projecting rib 125 at the lower forward end of catch element 126 which prevents the trigger 6 from rotating counterclockwise (as viewed in FIG. 1) until the catch element 126 is moved forward by the pin 116 engaging the ear 124 on the catch element 126 and urging it forward against the force of the spring 168. The trigger catch safety is always on whether the gun is open or closed after cocking. It always retains the trigger keeping if from being pulled unless it is unlocked. The safety is always in the locked position unless it is manually taken off safety.

Element 166 is a roll pin pressed into the trigger catch 126 and mounts a spring 168 holding it in place. The spring 168 urges the trigger catch 126 rearwardly.

The cap safety plunger 112 which is located in the cap 28 underneath the cap insert 72 and is pulled forward by the movement of the rear safety through the slider 35, disengages the safety mechanism. The receiver safety plunger 114, which only while the receiver is closed and in firing position and the rear safety is off, is moved by the cap safety plunger 112, which was just described above, and transmits movement of the cap safety plunger to the grip pin which, in turn, disengages the safety.

Element 170 is a lock pin biased by a spring 172 located in a hole basically in the center of the side of the cap 28. It is a pin that is under spring pressure and allows self locking of the cap insert assembly. In other words, it is a detent.

Element 176 is the take-down plunger which is located in the receiver 22; it has a dual purpose. It allows one to manually disassemble the receiver for taking the cap 28 off or cleaning. It is used as an open position stop when opening the cap 28. There is a small detent not shown inside the cap which the spring-loaded plunger 49 fits when the receiver or when the cap is in full open position creating a stop which prevents one from rotating too far or from unscrewing the entire cap from the receiver. It is spring biased by a spring 178 which keeps tension against the inside of the cap and creates the necessary energy to hold it in place.

I claim:

1. A single shot pistol having a barrel, a grip, a trigger and a firing pin;

a receiver secured to the rearward end of the barrel;

a cap threaded onto the receiver for relative rotation;

striker mechanism extending from the trigger to the firing pin, ejector mechanism in the receiver for ejecting a cartridge through an opening in the cap; and a camming ramp in the cap for actuating the ejector mechanism upon the cap being rotated relative to the receiver.

2. A single shot pistol having a barrel, a grip, a trigger and a firing pin, a receiver secured to the rearward end of the barrel, a cap threaded onto the receiver for relative rotation,
striker mechanism extending from the trigger to the firing pin,
ejector mechanism in the receiver for ejecting a cartridge, and
camming mechanism in the cap for initially cocking the striker mechanism and then for actuating the ejector mechanism upon the cap being rotated relative to the receiver.

3. A single shot pistol having a barrel, a grip, a trigger and a firing pin,
a receiver secured to the rearward end of the barrel,
a cap threaded onto the receiver for relative rotation,
striker mechanism extending from the trigger to the firing pin,
ejector mechanism in the receiver for ejecting a cartridge,
safety mechanism in the cap actuated manually to lock and unlock the trigger, and
camming mechanism in the cap for initially cocking the striker mechanism and actuating the ejector mechanism upon the cap being rotated relative to the receiver.

4. A single shot pistol according to claim 2, wherein there are means associated with the ejector mechanism for moving the ejector rearwardly of the receiver to initiate ejection and in a rotary direction to permit insertion of a new cartridge.

5. A single shot pistol according to claim 3, wherein there are means associated with the ejector mechanism for moving the ejector rearwardly of the receiver to initiate ejection and in a rotary direction to permit insertion of a new cartridge.

6. A single shot pistol according to claim 1, having a safety mechanism associated with the trigger.

7. A single shot pistol according to claim 2, having a safety mechanism associated with the trigger.

8. A single shot pistol according to claim 3, having a second safety mechanism associated with the trigger.

9. A single shot pistol according to claim 1, having mating threads on the barrel and in the receiver by which the barrel may be interchanged with a second barrel of different caliber.

10. A single shot pistol according to claim 2, having mating threads on the barrel and in the receiver by which the barrel may be interchanged with a second barrel of different caliber.

11. A single shot pistol according to claim 3, having mating threads on the barrel and in the receiver by which the barrel may be interchanged with a second barrel of different caliber.

12. A single shot pistol according to claim 2, wherein the ejector mechanism is removebly received in a recess in the receiver and is interchangeable with ejector mechanism of a different size.

13. A single shot pistol according to claim 3, wherein the ejector mechanism is removebly received in a recess in the receiver and is interchangeable with ejector mechanism of a different size.

* * * * *